US006395394B1

(12) United States Patent
Willemsen

(10) Patent No.: US 6,395,394 B1
(45) Date of Patent: May 28, 2002

(54) FINISH COMPOSITION FOR TREATING YARNS

(75) Inventor: Stephanus Willemsen, Rheden (NL)

(73) Assignee: Twaron Products B.V., Arnhem (NL)

( * ) Notice: Subject to any disclaimer, the term of this patent is extended or adjusted under 35 U.S.C. 154(b) by 0 days.

(21) Appl. No.: 09/550,611

(22) Filed: Apr. 17, 2000

(51) Int. Cl.[7] ..... D02G 3/02; D06M 9/00

(52) U.S. Cl. ..... 428/391; 428/364; 428/375; 428/395; 252/8.61; 252/8.63; 252/8.84

(58) Field of Search ..... 428/364, 375, 428/391, 395; 252/8.61, 8.84, 8.63

(56) References Cited

U.S. PATENT DOCUMENTS 4,434,008 A * 2/1984 Dumm et al. ..... 106/271
5,837,371 A * 11/1998 Rivas ..... 428/394

FOREIGN PATENT DOCUMENTS

EP 0 474 467 11/1992

OTHER PUBLICATIONS

Flory et al., "Abrasion Resistance of Polymeric Fibers in Marine Conditions, Proceedings 2nd International Conference on Polymers in a Marine Environment", London, 1989, pp. 197–204.

* cited by examiner

*Primary Examiner*—Cynthia H Kelly
*Assistant Examiner*—J. M. Gray
(74) *Attorney, Agent, or Firm*—Oliff & Berridge, PLC

(57) ABSTRACT

The invention pertains to a finish composition for treating yarns comprising a mixture of silicone oil emulsion and a wax emulsion wherein the amount of silicone oil is 0.5 to 30 wt. %, the amount of wax is 1.5 to 45 wt. %, the total of silicone oil and wax is 2 to 60 wt. %, and the ratio silicone oil:wax is <1, and to a yarn comprising the same. Preferably, the yarn is aramid yarn.

19 Claims, 1 Drawing Sheet

Alma fatigue tester

Fig. I
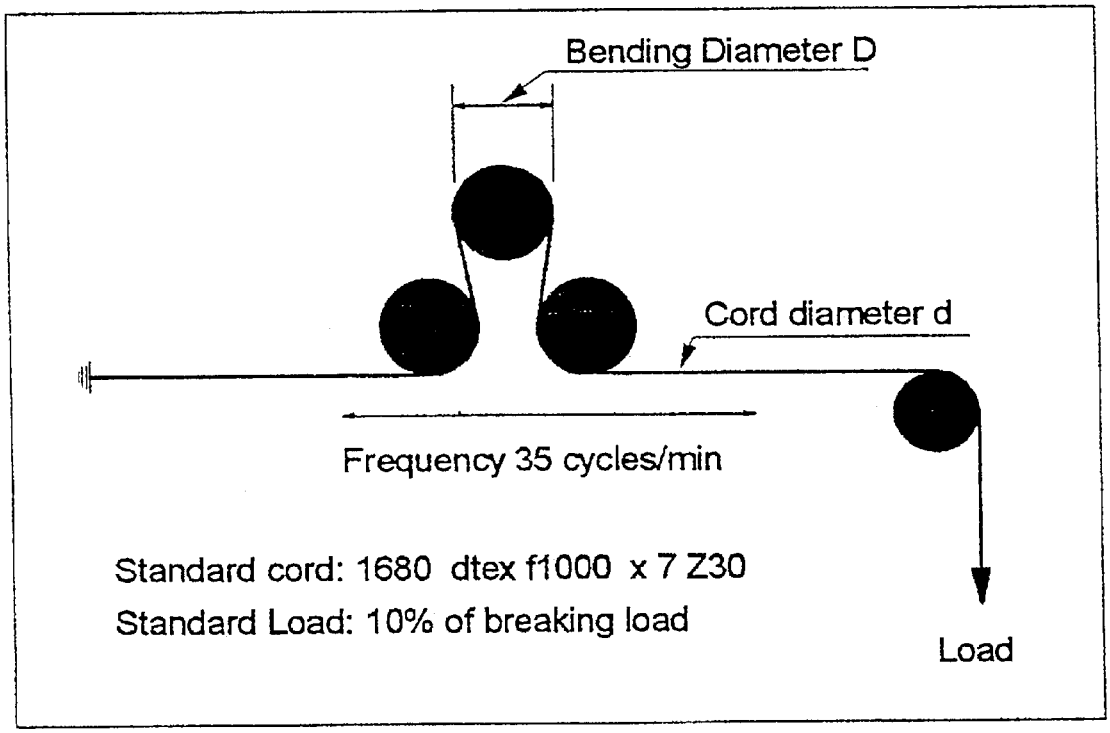
Alma fatigue tester

FINISH COMPOSITION FOR TREATING YARNS

The invention pertains to a finish composition for treating yarns and to yarns comprising said finish composition.

BACKGROUND OF THE INVENTION

To improve their characteristics, yarns are commonly treated with a finish or coating. Such treated yarns, also called fibers or threads, may show improved breaking strength, coefficient of friction, wear, fatigue, antistatic properties, and the like.

European patent application No. 0 474 467 to Griffin teaches a liquid composition comprising a silicone oil, a wax emulsion, and a silicone surfactant. This liquid composition can be applied to yarns. This composition can easily be applied using kiss roll methods without corroding or otherwise destroying the application equipment. However, this composition does not lead to improved wear and fatigue properties.

There is a need to improve the wear and fatigue properties of yarns, preferably by applying a suitable finish. This need is felt especially when yarns are wet, as is usually the case in the offshore and marine industry.

BRIEF DESCRIPTION OF THE INVENTION

The invention pertains to a finish composition for treating yarns comprising a mixture of silicone oil emulsion and a wax emulsion wherein the amount of silicone oil is 0.5 to 30 wt. %, the amount of wax is 1.5 to 45 wt. %, the total of silicone oil and wax is 2 to 60 wt. %, and the ratio silicone oil-wax is <1. These wt. % are based on the total ingredients, including water, of the finish composition. It was found that these finish compositions, when applied on yarns, considerably improve their wear and fatigue properties. The invention therefore also pertains to yarns comprising the above-mentioned finish composition.

DETAILED DESCRIPTION OF THE INVENTION

There are some striking differences between the composition of the instant invention and the composition disclosed in European patent application No. 0 474 467. This patent application discloses the use of silicone oil, whereas in the present invention both the silicone oil and the wax are used in the form of an emulsion. Even more importantly, the unique amounts of silicone oil and wax and, more particularly, the ratio in which these are used are of importance for obtaining the beneficial effects of the presently claimed composition. Remarkably, it appears that the ratio silicone oil:wax must be <1. When this ratio is greater than 1, as is the case in European patent application No. 0 474 467, the wear and fatigue properties of the finished yarn are not improved.

Preferably, the amount of silicone oil is 1 to 10 wt. %, the amount of wax is 3 to 25 wt. %, the total of silicone oil and wax is 4 to 35 wt. %, and the ratio silicone oil:wax is <1. More preferably, the amount of silicone oil is 2 to 4 wt. %, the amount of wax is 6 to 12 wt. %, the total of silicone oil and wax is 8 to 16 wt. %.

The silicone oil is emulsified in water. The silicone oil of the invention may be any suitable silicone oil that can be emulsified in water. Preferably, the silicone oil has a viscosity of 1,000 to 1,000,000 centistrokes at 25° C., more preferably 10,000 to 300,000 centistrokes. Preferred silicone oils are polyalkylsiloxanes, polyetheralkylsiloxanes, and mixtures thereof. Polyalkylsiloxane emulsions are commercially available, for instance the polydimethylsiloxane emulsion TEGO EMULSION HO™ (ex Hansa Textil Chemie GmbH). Preferably, the silicone oil emulsion has a viscosity of 10 to 500 centistrokes at 25° C.

The wax component in the finish composition is not very critical, and in principle any suitable wax can be used, such as petroleum waxes, polyethylene waxes, Fischer-Tropsch waxes, and natural waxes. Preferred waxes are selected from paraffin wax, carnauba wax, montan wax, and oxidized polyethylene wax. The waxes are used in an emulsion in water comprising 10 to 80 wt. % of the wax, preferably 30–60 wt. %.

The finish may comprise auxiliary compounds commonly present in finishes, such as surfactants. Suitable surfactants are silicone surfactants, for instance polydiorganosiloxane-polyoxyalkene copolymers, which are known in the art.

The finish can be used for any type of yarn, such as polyester yarn, polyarnide yarn, polyurethane yarn, aramid yarn, polyethylene yarn, and the like. Most preferably, the finish is applied onto aramid yarn. The most common aramid yarn is made of PPTA polymer and is available as TWARON® (ex Twaron Products), or less preferably, KEVLAR® (ex DuPont).

The finish is applied onto the yarn by methods known to a person of ordinary skill. A suitable method is, e.g., the application via a kiss roll, a finish bath, or a liquid applicator.

The finish can be applied onto the yarn as a combined emulsion comprising both the wax and silicone oil emulsions, or in a two-step process wherein first the wax emulsion is applied onto the yarn and then dried, followed by the application of the silicone oil emulsion onto the yarn, optionally followed by a drying step.

The following examples are presented to provide a more complete understanding of the invention. The specific techniques, conditions, materials, proportions, and reported data set forth to illustrate the principles of the invention are exemplary and should not be construed as limiting the scope of the invention.

EXAMPLE 1

A finish according to the invention (F1), a finish for comparison (P2), and a finish according to Example 2 of EP 0 474 467 (F3, reference) were prepared using as the wax a 40 wt. % emulsion of AQUACER 533™ (ex BYK-Cera bv; W1) or a 48 wt. % emulsion of RAYOLAN CPN™ (ex B öhme; W2), and as the silicone oil a 40 wt. % emulsion of HANSA LUB HO™ (ex Hansa Textil Chemie GmbH; S1), pure WACKER AK50™ (ex Wacker; S2), or pure SILWET SURFACTANT L7602™ (ex Union Carbide; S3). Further a finish comprising the wax emulsion without the silicone oil emulsion (Fw) and a finish comprising the silicone oil emulsion without the wax emulsion (Fs) were used. These finishes were denoted in Table 1 (in parts of components other than water).

TABLE 1

| | F1 invention | F2 comparison | F3 reference | Fw | Fs |
|---|---|---|---|---|---|
| W1 | 75 | 20 | | 100 | |
| W2 | | | 20 | | |
| S1 | 25 | 80 | | | 100 |
| S2 | | | 78 | | |
| S3 | | | 2 | | |

TWARON® 1010, 1680 dtex (ex Twaron Products) yarn was treated with finishes F1 and F2 before entering a steam box, using a liquid applicator consisting of a ceramic pin and a dosing pump before the heating section. The finished yarn was heated at 200° C. in the 10 m long steam box. Its residence time was 8 sec. The finishes were applied onto the yarn in amounts of 5 or 12 wt. %.

Finish F3 was rather unstable and has to be stirred before application. This finish was applied onto the same TWARON feed yarn using a ceramic pin and a laboratory dosage injector. The finished yarn was not dried in the steam box. The finish was applied onto the yarn in an amount of 5%.

Finishes Fw and Fs were applied onto the yarn in the same manner as finishes F1 and F2, in an amount of 5 and 3 wt. %, respectively.

Finish F4 was obtained by first applying 5 wt. % Fw onto the yarn and drying the yarn, followed by applying 3 wt. % Fs, after which the yarn was not dried further in the steam box. The total amount of finish on the yarn was 8 wt. %.

The yarns were tested for their wet abrasion properties using the Flory test (Flory et al., Abrasion Resistance of Polymeric Fibers in Marine Conditions, Proceedings 2$^{nd}$ International Conference on Polymers in a Marine Environment, London, 1989, pp. 197–204). Instead of three 25 mm pulleys, a 20 mm and a 35 mm top pulley, and a 20 mm lower pulley were used. The distance between the top pulleys was 10 cm instead of 14 cm. The tension weight was 40 mN/tex and the length of the strokes was 48 mm instead of 50 mm.

The wet bending fatigue properties were determined in the Alma test (FIG. 1).

For this test the yarn was cabled to a cord of 1680 dtex X 7, Z30. The cord having a theoretical cord diameter of 1.22 mm was fixed over three 40 mm pulleys according to the figure, and loaded with a weight of 10% of the initial cord breaking strength (21 kg).

The cord was continuously wetted with tap water. The three pulleys were moved from right to left and back again (1 return movement) with 35 return movements/min, leading to 35×2×3=210 bend changes/min. The number of bend changes before breakage of the cord was determined. The test was repeated 18 times and the mean number of bend changes is given as the Alma test. The results are denoted in Table 2.

TABLE 2

| | Flory Test | Alma Test |
|---|---|---|
| TWARON yarn with finish F1 12 wt. % | 4,800 | 156,000 |
| TWARON yarn with finish F1 5 wt. % | 3,000 | 57,000 |
| TWARON yarn with finish F2 12 wt. % | 3,200 | 102,700 |
| TWARON yarn with finish F3 5 wt. % | 400 | 22,400 |
| TWARON yarn with finish Fw 5 wt. % | 1,600 | 55,000 |
| TWARON yarn with finish Fs 3 wt. % | 870 | not determined |
| TWARON yarn with finish F4 8 wt. % | 3,500 | 99,000 |

It can be concluded that the use of silicone oil is such (F3) does not provide yarns with acceptable wet abrasion and wet bending fatigue properties. Using silicone oil emulsions improves both wear and fatigue even when the ratio silicone oil:wax is greater than 1 (F2). Considerable further improvement has been obtained when the ratio silicone oil:wax is less than 1 (F1).

EXAMPLE 2

Analogous to Fw, Fs, and F4 of Example 1, the following finishes F5–F7 were prepared (Table 3):

TABLE 3

| | F5 wax only | F6 silicone oil only | F7 invention |
|---|---|---|---|
| AQUACER 535 ™ (30%)* | 100 | | 79.2 |
| HANS LUB LZ ™ (38%)** | | 100 | 20.8 |

*ex BYK-Cera bv
**ex Hansa Textil Chemie GmbH

According to Example 1, Flory tests were performed with cords made of TWARON® yarn. The results are depicted in Table 4.

TABLE 4

| | Flory Test |
|---|---|
| TWARON yarn with finish F5 3 wt. % | 740 |
| TWARON yarn with finish F5 3 wt. % and F6 1 wt. % | 1,200 |
| TWARON yarn with finish F7 4 wt. % | 1,300 |

It can be concluded that cords made of finished yarns obtained by the application of an emulsion comprising both silicone oil and wax (F7) leads to results comparable to those for cords made of yarns obtained in a two-step process with the application of a wax emulsion being followed by the application of a silicone oil emulsion (F5/F6).

I claim:

1. A finish composition for treating yarns comprising a mixture of a silicone oil emulsion and a wax emulsion wherein the amount of silicone oil is 0.5 to 30 wt. %, the amount of wax is 1.5 to 45 wt. %, the total of silicone oil and wax is 2 to 60 wt. %, and the ratio silicone oil:wax is <1.

2. The finish composition of claim 1 wherein the amount of silicone oil is 1 to 10 wt. %, the amount of wax is 3 to 25 wt. %, the total of silicone oil and wax is 4 to 35 wt. %, and the ratio silicone oil:wax is <1.

3. The finish composition of claim 1 wherein the amount of silicone oil is 2 to 4 wt. %, the amount of wax is 6 to 12 wt. %, the total of silicone oil and wax is 8 to 16 wt. %, and the ratio silicone oil:wax is <1.

4. The finish composition of claim 1 wherein the silicone oil has a viscosity of 1,000 to 1,000,000 centistrokes at 25° C.

5. The finish composition of claim 4 wherein the silicone oil is a polydimethylsiloxane.

6. The finish composition of claim 5 wherein the wax is selected from the group consisting of paraffin wax, carnauba wax, montan wax, and oxidized polyethylene wax.

7. The finish composition of claim 1 wherein the silicone oil is selected from the group consisting of polyalkylsiloxane, polyetheralkylsiloxane, and a mixture thereof.

8. The finish composition of claim 7 wherein the wax is selected from the group consisting of paraffin wax, carnauba wax, montan wax, and oxidized polyethylene wax.

9. The finish composition of claim 1 wherein the wax is selected from the group consisting of paraffin wax, carnauba wax, montan wax, and oxidized polyethylene wax.

10. A yarn comprising a yarn treated with a finish composition for treating yarns, said finish composition comprising a mixture of a silicone oil emulsion and a wax emulsion wherein the amount of silicone oil is 0.5 to 30 wt. %, the amount of wax is 1.5 to 45 wt. %, the total of silicone oil and wax is 2 to 60 wt. %, and the ratio silicone oil:wax is <1.

11. The yarn of claim 10 wherein the amount of silicone oil is 1 to 10 wt. %, the amount of wax is 3 to 25 wt. %, the total of silicone oil and wax i3 4 to 35 wt. %, and the ratio silicone oil:wax is <1.

12. The yarn of claim 10 wherein the amount of silicone oil is 2 to 4 wt. %, the amount of wax is 6 to 12 wt. %, the total of silicone oil and wax is 8 to 16 wt. %, and the ratio silicone oil:wax is <1.

13. The yarn of claim 10 wherein the silicone oil has a viscosity of 1,000 to 1,000,000 centistrokes at 25° C.

14. The yarn of claim 13 wherein the silicone oil is a polydimethylsiloxane.

15. The yarn of claim 14 wherein the wax is selected from the group consisting of paraffin wax, carnauba wax, montan wax, and oxidized polyethylene wax.

16. The yarn of claim 10 wherein the silicone oil is selected from the group consisting of polyalkylsitoxane, polyethieralkylsiloxane, and a mixture thereof.

17. The yarn of claim 16 wherein the wax is selected from the group consisting of paraffin wax, carnauba wax, montan wax, and oxidized polyethylene wax.

18. The yarn of claim 10 wherein the wax is selected from the group consisting of paraffin wax, carnauba wax, montan wax, and oxidized polyethylene wax.

19. The yarn of claim 10 wherein the yarn is an aramid yarn.

* * * * *

UNITED STATES PATENT AND TRADEMARK OFFICE

CERTIFICATE OF CORRECTION

PATENT NO. : 6,395,394 B1
DATED : May 28, 2002
INVENTOR(S) : Stephanus Willemsen It is certified that error appears in the above-identified patent and that said Letters Patent is hereby corrected as shown below:

Column 2,
Line 17, delete "polyarnide" and insert -- polyamide --.
Line 41, delete "P2" and insert -- F2 --.
Lines 44 and 45, don't split "Böhme".

Column 3,
Lines 19-22, insert quotation marks around article title.
Lines 29 and 30, no new paragraph at "For this test…".
Line 56, delete "is" and insert -- as --.

Signed and Sealed this

Nineteenth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,395,394 B1
DATED : May 28, 2002
INVENTOR(S) : Stephanus Willemsen It is certified that error appears in the above-identified patent and that said Letters Patent is hereby corrected as shown below:

Column 2,
Between lines 15 and 16, insert the following paragraph:

-- The finish can be applied onto the yarn in an amount of 4 to 50 wt.%, preferably between 4 and 35 wt.%, and more preferably between 8 and 16 wt.%. --

Signed and Sealed this

Eighth Day of June, 2004

JON W. DUDAS
*Acting Director of the United States Patent and Trademark Office*